US010357122B2

(12) United States Patent
Wendling

(10) Patent No.: US 10,357,122 B2
(45) Date of Patent: Jul. 23, 2019

(54) APPARATUS TO PREVENT CURLING OF A RUG CORNER

(71) Applicant: Allan Wendling, New Lothrop, MI (US)

(72) Inventor: Allan Wendling, New Lothrop, MI (US)

( * ) Notice: Subject to any disclaimer, the term of this patent is extended or adjusted under 35 U.S.C. 154(b) by 0 days.

(21) Appl. No.: 15/196,139

(22) Filed: Jun. 29, 2016

(65) Prior Publication Data

US 2016/0302603 A1 Oct. 20, 2016

Related U.S. Application Data

(63) Continuation-in-part of application No. 14/730,849, filed on Jun. 4, 2015, now abandoned, which is a continuation-in-part of application No. 14/542,774, filed on Nov. 17, 2014, now abandoned.

(51) Int. Cl.
*A47G 27/04* (2006.01)

(52) U.S. Cl.
CPC ..... *A47G 27/0431* (2013.01); *A47G 27/045* (2013.01); *Y10T 428/14* (2015.01)

(58) Field of Classification Search
CPC ..... C09J 7/02; C09J 7/0225; C09J 2203/314; A47G 27/0431; A47G 27/0418; B32B 38/10; Y10T 428/14; Y10T 16/14
See application file for complete search history.

(56) References Cited

U.S. PATENT DOCUMENTS

| | | | | |
|---|---|---|---|---|
| 922,703 | A | 5/1909 | Knapp | |
| 1,509,047 | A | 9/1924 | Lindhorst | |
| 3,559,273 | A | 2/1971 | Samaris et al. | |
| 4,681,786 | A | 7/1987 | Brown | |
| 6,673,409 | B1 * | 1/2004 | Wheatley | B60R 7/02 296/97.3 |
| 2005/0025926 | A1 * | 2/2005 | Risi | C09J 5/00 428/40.1 |
| 2011/0074128 | A1 | 3/2011 | Chang | |
| 2012/0285613 | A1 | 11/2012 | Bongiovanni et al. | |
| 2016/0029826 | A1 | 2/2016 | Bongiovanni et al. | |

* cited by examiner

*Primary Examiner* — Patricia L. Nordmeyer
(74) *Attorney, Agent, or Firm* — Dinsmore & Shohl LLP

(57) ABSTRACT

An apparatus to prevent curling of a rug corner. The apparatus includes a rigid and planar V-shaped body having a top surface and a bottom surface. An adhesive layer is applied to at least a portion of the top surface of the body while a removable protective cover is provided over the adhesive layer. Upon removal of the protective cover and exposure of the adhesive layer, the body is adhered to the rug corner by the adhesive. Upon doing so, the body maintains the rug corner in a flat condition thus preventing any curling of the rug.

18 Claims, 1 Drawing Sheet

APPARATUS TO PREVENT CURLING OF A RUG CORNER

CROSS-REFERENCE TO RELATED APPLICATIONS

This application is a continuation-in-part of U.S. patent application Ser. No. 14/730,849 filed Jun. 4, 2015, entitled "Apparatus to Prevent Curling of a Rug Corner", which is a continuation-in-part of U.S. patent application Ser. No. 14/542,774 filed Nov. 17, 2014.

BACKGROUND OF THE INVENTION

I. Field of the Invention

The present invention is related to a device for preventing curling of a rug corner.

II. Description of Related Art

Many homes, office buildings, and the like use area rugs on the floor for decorative or other purposes. These area rugs are typically rectangular in shape and ideally lie flatly on the floor surface.

Unfortunately, over time, the corners of the rug curl upwardly away from the floor surface. When this occurs, the upwardly curled corner of the rug is not only visually unattractive but also presents a safety hazard in which people can trip on the corner of the rug. This is particularly serious in commercial establishments where people who trip on the upwardly curled corner of the rug may fall and hurt themselves and create legal and financial liability.

SUMMARY OF THE PRESENT INVENTION

The present invention provides an apparatus to prevent curling of a rug corner that overcomes all of the above-mentioned disadvantages of the prior art.

In brief, the apparatus of the present invention comprises a rigid and planar V-shaped body. The body has a planar top and a planar bottom which is spaced from the planar top by a small distance, e.g. one eighth of an inch.

An adhesive layer is applied to at least a portion of the top of the body. A removable protective cover is then provided over the adhesive layer to protect the adhesive layer when the apparatus of the present invention is not in use.

When use of the device of the present invention is desired, the protective cover for the adhesive layer is removed. The body is then adhered to the bottom of the rug corner by the adhesive layer. Upon doing so, the rigid and planar V-shaped body maintains the rug corner in a flat condition. Consequently, when the rug corner is again laid on the ground surface, the body is positioned between the floor and the rug corner and not only provides an anti-slip protection for the rug, but also prevents curling of the rug corner.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
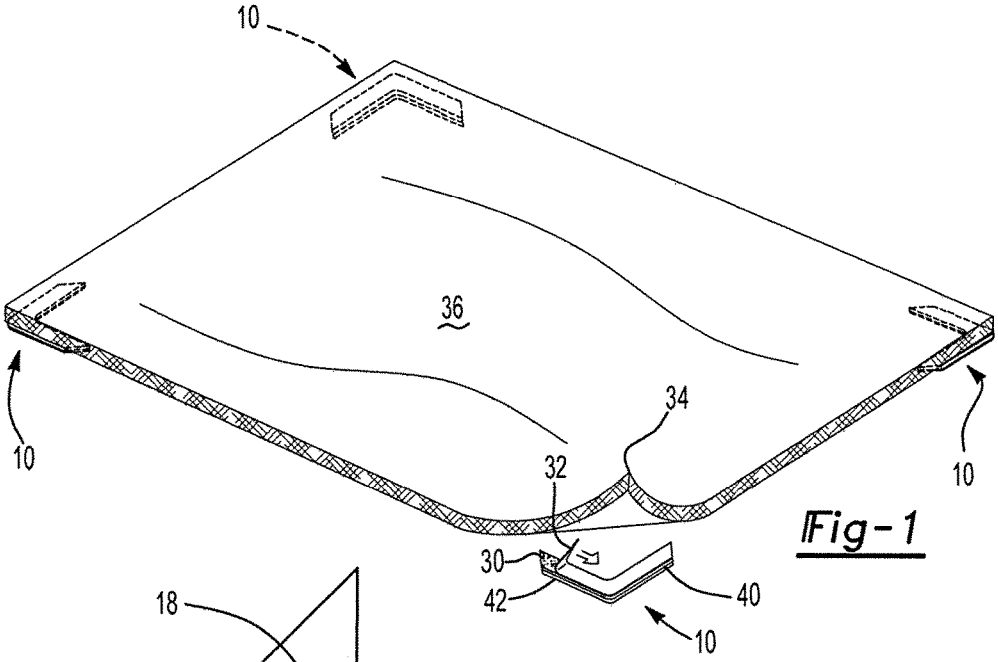
FIG. 1 is an elevational view illustrating the application of the device of the present invention.
Figure 2:
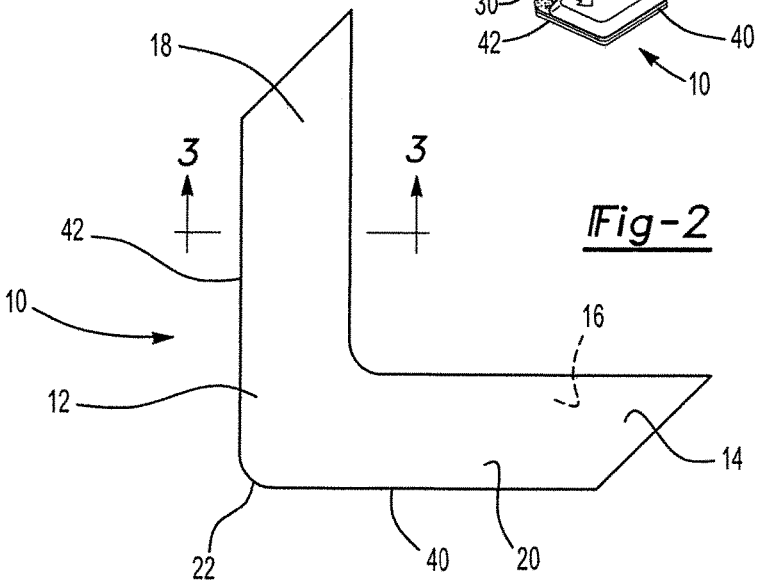
FIG. 2 is a top view illustrating a preferred embodiment of the present invention.

With reference first to FIGS. 1 and 2, a preferred embodiment of the apparatus 10 to prevent curling of a rug corner is shown. The apparatus 10 includes a V-shaped body 12 with a top 14 and bottom 16. The body 12, furthermore, includes two elongated legs 18 and 20 which intersect together generally perpendicularly and with a rounded nose 22.

Figure 3:
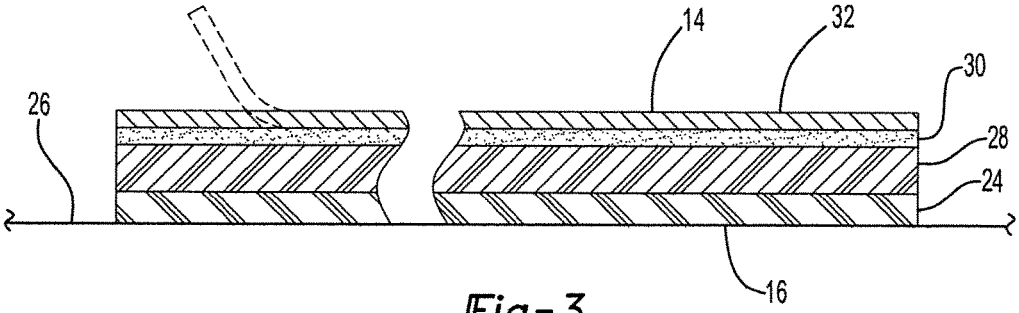
FIG. 3 is a sectional view taken along line 3-3 in FIG. 2 and enlarged for clarity.

As best shown in FIG. 3, the body is a laminate structure and comprises a bottom elastomeric layer 24 of an elastomeric material. This elastomeric material is adapted to abut against a floor surface 26 and, in doing so, prevents slippage between the apparatus 10 and the floor surface 26.

A plastic layer 28, preferably made of polypropylene copolymer, overlies the bottom elastomeric layer 24. The plastic layer 28 is preferably made of a rigid plastic material and maintains the entire body 12 in a rigid form. The plastic layer 28 and elastomeric layer 24 are preferably approximately one eighth of an inch in thickness and are attached together in any conventional fashion. Preferably, the elastomeric layer 24 comprises a sticky gel (polyurethane gel) covered by a removable backing. Alternatively, the bottom layer comprises a synthetic rubber layer such as Santoprene® by ExxonMobil Corporation. Both layers 24 form an anti-slip layer for the rug.

Alternatively, the bottom layer 24 is made of a sticky gel. The sticky gel adheres to the floor to prevent slippage, but without marring or otherwise damaging the floor surface 26.

A thin adhesive layer 30, such as 3M adhesive (acrylic foam tape), is then provided over at least a portion of the plastic layer 28. This adhesive layer 30 is then covered by a protective cover 32, preferably made out of paper or a synthetic material, and which remains attached to the body 12 until use of the apparatus 10 is desired.

With reference now to FIG. 1, when use of the apparatus 10 is desired, the protective cover 32, preferably made of paper, is first removed from the body 12 thus exposing the adhesive layer 30. The body 12 is then aligned with a corner 34 of a rug 36 so that one edge 42 of the one leg 18 of the body 12 extends closely adjacent one edge of the corner 34 of the rug 36 while an edge 40 of the leg 20 of the body 12 extends closely adjacent another edge of the corner 34 of the rug 36.

By pressing the apparatus 10 and leg together, the apparatus 10 is thus adhered to the corner 34 of the rug. When this happens, the rigid and planar body 12 of the apparatus 10 maintains the corner in a flat condition. As the corner is then lowered onto the floor 28, the elastomeric layer 24 contacts the floor 28 and prevents slipping of the corner of the rug. Simultaneously, the rigid body 12 maintains the corner in a flat condition.

From the foregoing, it can be seen that the present invention provides a simple yet effective apparatus for preventing curling of rug corners of area rugs. Having described my invention, however, many modifications thereto will become apparent to those skilled in the art to which it pertains without deviation from the spirit of the invention as defined by the scope of the appended claims.

I claim:

1. Apparatus to prevent curling of a rug corner away from a floor surface, the apparatus comprising:

a rigid and planar V-shaped body, said body having a planar top and planar bottom, an adhesive layer applied to at least a portion of said top of said body, a removable protective cover provided over said adhesive layer, and a sticky polyurethane gel layer that includes a first surface and an opposite second surface, said first surface is attached to at least a portion of said planar bottom of said body, said second surface of said sticky polyurethane gel layer is configured to contact the floor surface, wherein upon removal of said protective cover and exposure of said adhesive layer, said body is adhered to the rug corner by said adhesive whereby said body maintains the rug corner in a flat condition, wherein the body and the sticky polyurethane gel layer are a laminate structure.

2. The apparatus as defined in claim 1 wherein said body comprises a rigid layer.

3. The apparatus as defined in claim 2 wherein said rigid layer comprises a plastic layer, said adhesive layer being applied to a top of said plastic layer.

4. The apparatus as defined in claim 1 wherein said body comprises two elongated legs which intersect each other perpendicularly.

5. The apparatus as defined in claim 4 wherein said legs are coplanar.

6. The apparatus as defined in claim 4 wherein said body includes a rounded nose at the junction of said legs.

7. Apparatus to prevent curling of a rug corner away from a floor surface, the apparatus comprising:

a laminate structure comprising:

a rigid and planar V-shaped body, said body having a planar top and planar bottom; and a sticky polyurethane gel layer that includes a first surface and an opposite second surface, said first surface is laminated to said planar bottom of said body;

an adhesive layer applied to at least a portion of said top of said body; and a removable protective cover provided over said adhesive layer, wherein upon removal of said protective cover and exposure of said adhesive layer, said laminate structure is adhered to the rug corner by said adhesive whereby said body maintains the rug corner in a flat condition and said second surface of said sticky polyurethane gel layer is configured to adhere to the floor surface to prevent slipping of the rug corner.

8. The apparatus as defined in claim 7 wherein said body comprises a rigid layer.

9. The apparatus as defined in claim 8 wherein said rigid layer comprises a plastic layer, said adhesive layer being applied to a top of said plastic layer.

10. The apparatus as defined in claim 7 wherein said body comprises two elongated legs which intersect each other perpendicularly.

11. The apparatus as defined in claim 10 wherein said legs are coplanar.

12. The apparatus as defined in claim 10 wherein said body includes a rounded nose at the junction of said legs.

13. Apparatus to prevent curling of a rug corner away from a floor surface, the apparatus consisting of:

a laminate structure comprising:

a rigid and planar V-shaped body, the body having a planar top and an opposite planar bottom; and a sticky polyurethane gel layer that includes a first surface and an opposite second surface, the first surface is laminated to said planar bottom of said body, an adhesive layer applied to at least a portion of the top of the body; and a removable protective cover provided over the adhesive layer, wherein upon removal of said protective cover and exposure of the adhesive layer, said laminate structure is adhered to the rug corner by said adhesive whereby said body maintains the rug corner in a flat condition and said second surface of said sticky polyurethane gel layer is configured to adhere to the floor surface to prevent slipping of the rug corner.

14. The apparatus as defined in claim 13 wherein said body comprises a rigid layer.

15. The apparatus as defined in claim 14 wherein said rigid layer comprises a plastic layer, said adhesive layer being applied to a top of said plastic layer.

16. The apparatus as defined in claim 13 wherein said body comprises two elongated legs which intersect each other perpendicularly.

17. The apparatus as defined in claim 16 wherein said legs are coplanar.

18. The apparatus as defined in claim 16 wherein said body includes a rounded nose at the junction of said legs.

* * * * *